US008077006B2

(12) United States Patent
Mui

(10) Patent No.: US 8,077,006 B2
(45) Date of Patent: Dec. 13, 2011

(54) TRANSMISSION LINE IMPEDANCE TRANSFORMER AND RELATED METHODS

(75) Inventor: Andrew Mui, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 66 days.

(21) Appl. No.: 12/768,542

(22) Filed: Apr. 27, 2010

(65) Prior Publication Data

US 2011/0260823 A1 Oct. 27, 2011

(51) Int. Cl.
*H01F 5/00* (2006.01)

(52) U.S. Cl. ..... 336/200; 336/223; 336/212; 29/602.1

(58) Field of Classification Search ..... 336/200, 336/223, 232, 212; 29/602.1
See application file for complete search history.

(56) References Cited

U.S. PATENT DOCUMENTS

| | | | | |
|---|---|---|---|---|
| 4,839,616 | A * | 6/1989 | Herzog | 333/32 |
| 5,353,001 | A | 10/1994 | Meinel et al. | 336/83 |
| 5,598,327 | A | 1/1997 | Somerville et al. | 363/131 |
| 5,949,321 | A | 9/1999 | Grandmont et al. | 336/232 |
| 6,069,548 | A * | 5/2000 | Baarman et al. | 336/65 |
| 6,888,438 | B2 | 5/2005 | Hui et al. | 336/200 |
| 7,180,397 | B1 * | 2/2007 | Busletta et al. | 336/200 |
| 7,432,793 | B2 * | 10/2008 | Nussbaum | 336/223 |
| 2002/0070835 | A1 | 6/2002 | Dadafshar | 336/200 |
| 2002/0070836 | A1 | 6/2002 | Fujiyoshi et al. | 336/200 |
| 2002/0159214 | A1 | 10/2002 | Perlick et al. | 361/160 |
| 2002/0170745 | A1 | 11/2002 | Opitz et al. | 174/255 |
| 2004/0113739 | A1 | 6/2004 | Du et al. | 336/200 |
| 2004/0239466 | A1 * | 12/2004 | Rouser | 336/200 |
| 2004/0257190 | A1 | 12/2004 | Peck et al. | 336/212 |
| 2007/0075818 | A1 * | 4/2007 | Hansen | 336/200 |
| 2008/0012680 | A1 | 1/2008 | Muelleman | 336/212 |
| 2008/0079524 | A1 | 4/2008 | Suzuki | 336/61 |
| 2008/0231403 | A1 | 9/2008 | Hsu | 336/180 |

* cited by examiner

*Primary Examiner* — Anh Mai
(74) *Attorney, Agent, or Firm* — Allen, Dyer, Doppelt, Milbrath & Gilchrist, P.A.

(57) ABSTRACT

A transmission line impedance transformer may include a printed circuit board (PCB) having a dielectric layer and an electrically conductive layer thereon defining a medial interconnection portion, and first and second lateral loop portions extending laterally outwardly from opposing first and second sides of the medial interconnection portion. The PCB also may have first ferrite body receiving openings therein adjacent the first lateral loop portion and second ferrite body receiving openings therein adjacent the second lateral loop portion. The transmission line impedance transformer may also include a first ferromagnetic body extending through the first ferrite body receiving openings to surround the first lateral loop portion, and a second ferromagnetic body extending through the second ferrite body receiving openings to surround the second lateral loop portion.

17 Claims, 7 Drawing Sheets

$Z \sim V^2$ $Z : 4Z$

TRANSMISSION LINE IMPEDANCE TRANSFORMER AND RELATED METHODS

FIELD OF THE INVENTION

The present invention relates to the field of transformers, and, more particularly, to radio frequency transmission line impedance transformers and related methods.

BACKGROUND OF THE INVENTION

Wireless communications devices are an integral part of society and permeate daily life. The typical wireless communications device includes an antenna, and a transceiver coupled to the antenna. The transceiver and the antenna cooperate to transmit and receive communications signals.

A typical radio frequency (RF) transceiver includes a power amplifier for amplifying low amplitude signals for transmission via the antenna. Given that most mobile communications devices operate on limited battery power, energy efficient power amplifiers may be desirable. More specifically and as will be appreciated by those skilled in the art, Class C and E power amplifiers are common in certain communications devices since they are efficient power amplifiers. These classes of power amplifiers are more efficient than Class A or B amplifiers, for example, but are subject to performance tradeoffs. For example, they may be nonlinear over certain frequencies and may introduce greater amounts of distortion into the amplified signal (if the signal requires a linear amplifier).

As will be appreciated by those skilled in the art, in high power amplifier applications, amplifiers are typically used to amplify signals received via transmission lines. In these applications, it may be necessary to transform the impedances of the transmission lines coupled to the input and output of the amplifier to match the load line impedance of the amplifier. As will be appreciated by those skilled in the art, the matched impedances provide greater efficiency with lower losses and greater bandwidth for the transmitted signal.

To improve the low end frequency response, magnetic materials, for example, ferrite may be added to the impedance transformer. For example, with reference to FIGS. 1-2, a ferrite impedance transformer 20 is now described. The ferrite impedance transformer 20 matches differing impedances between an input 25 and an output 26, illustratively, a 1:4 ratio. The ferrite impedance transformer 20 illustratively includes a circuit board 21, a plurality of ferrite cores 23*a*-23*b*, 24*a*-24*b* mounted on the circuit board, and a pair of rigid coaxial cables 22*a*-22*b* wound through each of the ferrite cores.

This ferrite impedance transformer 20 may suffer from several drawbacks. For example, the ferrite impedance transformer 20 may be difficult to manufacture, as the rigid coaxial cables 22*a*-22*b* are hard to manipulate. Moreover, the rigid coaxial cable 22*a*-22*b* may be expensive, and may be typically hand wound and hand soldered onto the circuit board 21. Further, given the manual labor-intensive manufacture process, the ferrite impedance transformer 20 may be subject to significant variation in electrical performance.

SUMMARY OF THE INVENTION

In view of the foregoing background, it is therefore an object of the present invention to provide a transmission line impedance transformer that is readily manufactured.

This and other objects, features, and advantages in accordance with the present invention are provided by a transmission line impedance transformer. The transmission line impedance transformer includes a printed circuit board (PCB) comprising at least one dielectric layer and at least one electrically conductive layer thereon defining a medial interconnection portion, and first and second lateral loop portions extending laterally outwardly from opposing first and second sides of the medial interconnection portion. The PCB also includes a first plurality of ferrite body receiving openings therein adjacent the first lateral loop portion, and a second plurality of ferrite body receiving openings therein adjacent the second lateral loop portion. The transmission line impedance transformer also includes at least one first ferromagnetic body extending through the first plurality of ferrite body receiving openings to surround the first lateral loop portion, and at least one second ferromagnetic body extending through the second plurality of ferrite body receiving openings to surround the second lateral loop portion. Advantageously, the transmission line impedance transformer may be planar and may be manufactured without the typical wound rigid coaxial cables.

More particularly, the medial interconnection portion may define an input and an output. For example, the input and the output may have different impedances. The electrically conductive layer may comprise a pair thereof, and the medial interconnection portion may comprise at least one electrically conductive via extending between the pair of electrically conductive layers.

In some embodiments, each of the first and second lateral loop portions may comprise at least one U-shaped conductive trace. Additionally, the first ferromagnetic body may comprise a first plurality thereof for surrounding the first lateral loop portion, and the at least one second ferromagnetic body may comprise a second plurality thereof for surrounding the second lateral loop portion.

Moreover, the at least one first ferromagnetic body may comprise a respective first pair of joined together segments, and the at least one second ferromagnetic body may also comprise a respective second pair of joined together segments.

Further, in some embodiments, each of the at least one first and at least one second ferromagnetic bodies may comprise a respective tubular ferromagnetic body. For example, the PCB and the at least one first and second ferromagnetic bodies may define an impedance transformer operable over a frequency range of 2 to 500 MHz.

Another aspect is directed to a method of making a transmission line impedance transformer. The method includes providing a printed circuit board (PCB) comprising at least one dielectric layer, and forming at least one electrically conductive layer on the PCB defining a medial interconnection portion, and first and second lateral loop portions extending laterally outwardly from opposing first and second sides of the medial interconnection portion. The method also includes forming a first plurality of ferrite body receiving openings in the PCB adjacent the first lateral loop portion and forming a second plurality of ferrite body receiving openings in the PCB adjacent the second lateral loop portion. The method also includes positioning at least one first ferromagnetic body to extend through the first plurality of ferrite body receiving openings and to surround the first lateral loop portion, and positioning at least one second ferromagnetic body to extend through the second plurality of ferrite body receiving openings and to surround the second lateral loop portion.

DETAILED DESCRIPTION OF THE PREFERRED EMBODIMENTS

Figure 1:
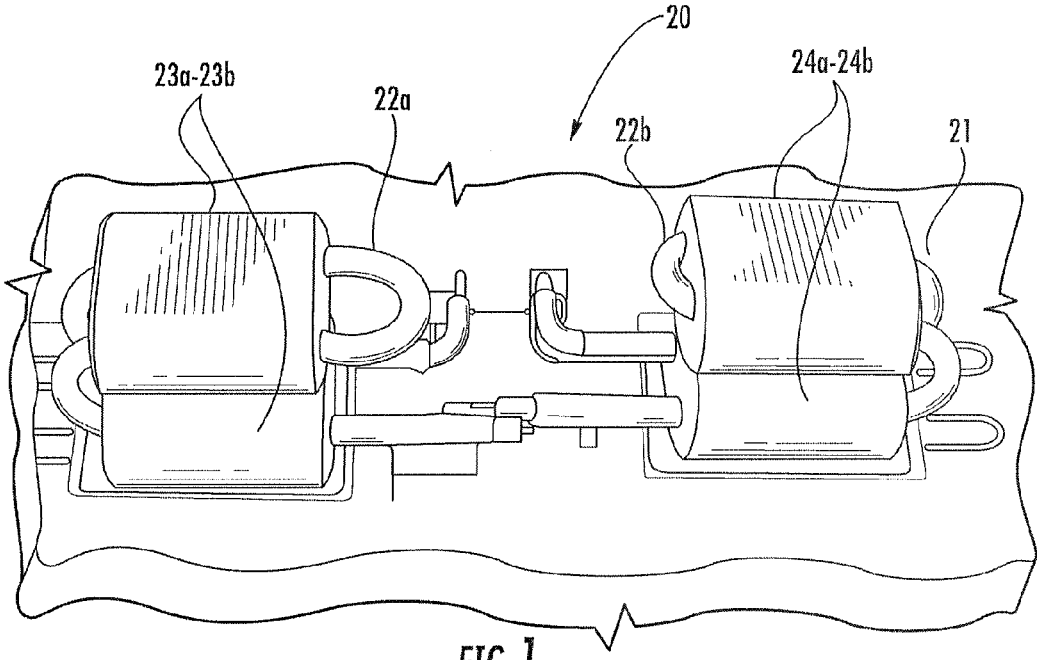
FIG. 1 (PRIOR ART)
FIG. 1 is a perspective view of a transmission line transformer, according to the prior art.
Figure 2:
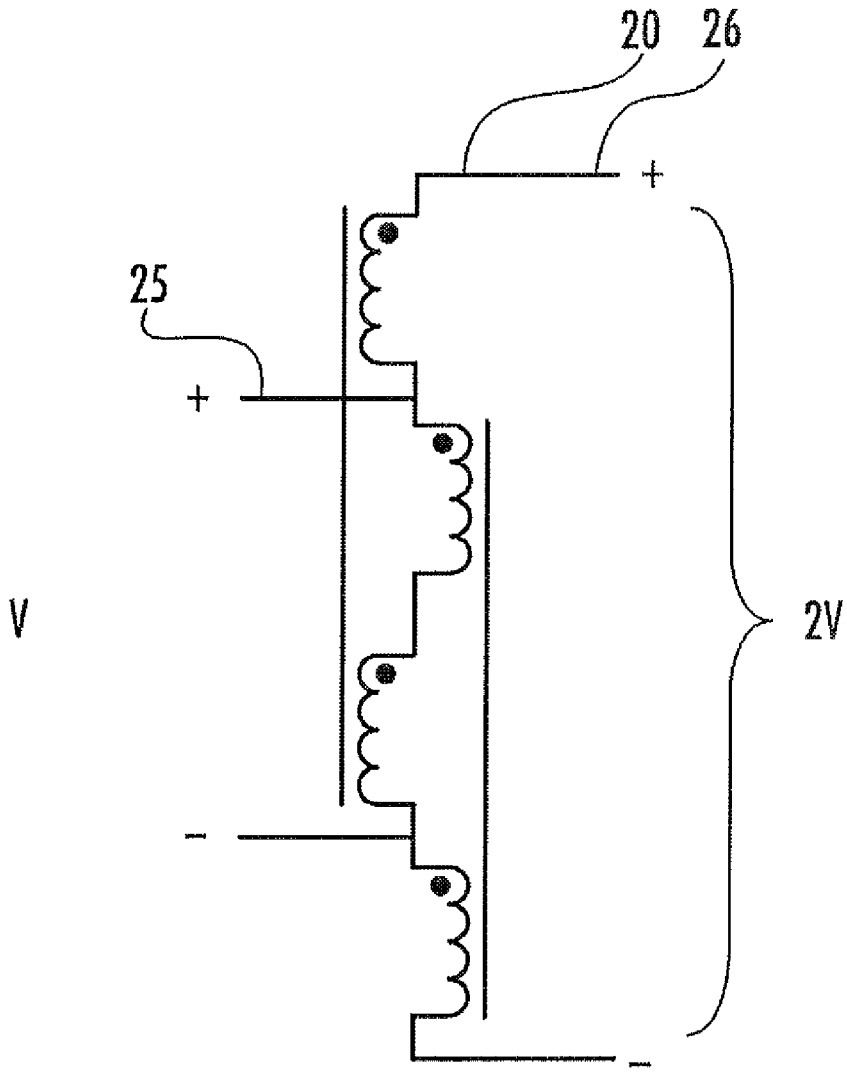
FIG. 2 (PRIOR ART)
FIG. 2 is a schematic circuit diagram of the transmission line transformer of FIG. 1.
Figure 3:
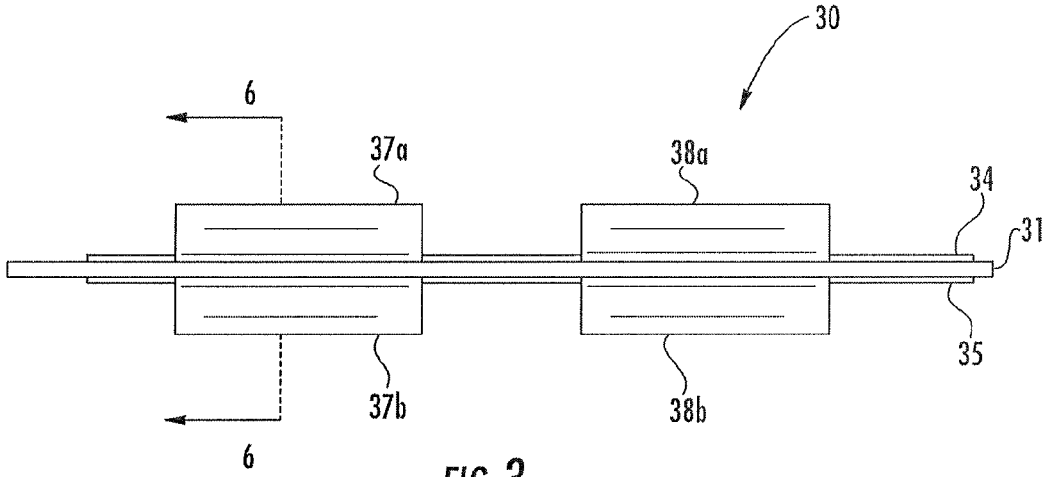
FIG. 3 is a side elevational view of a transmission line transformer, according to the present invention.
Figure 4:
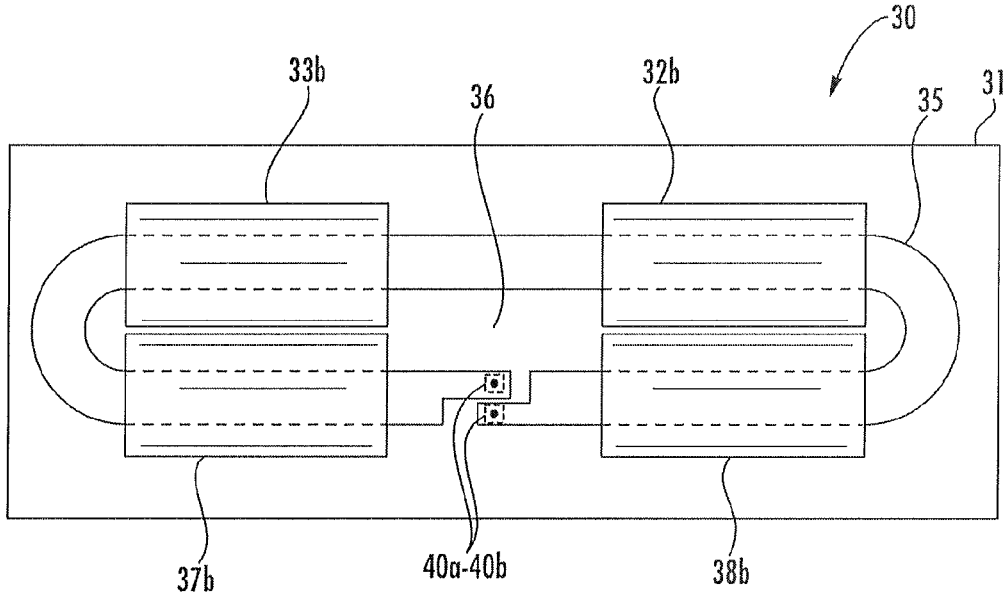
FIG. 4 is a bottom view of the transmission line transformer of FIG. 3.
Figure 5:
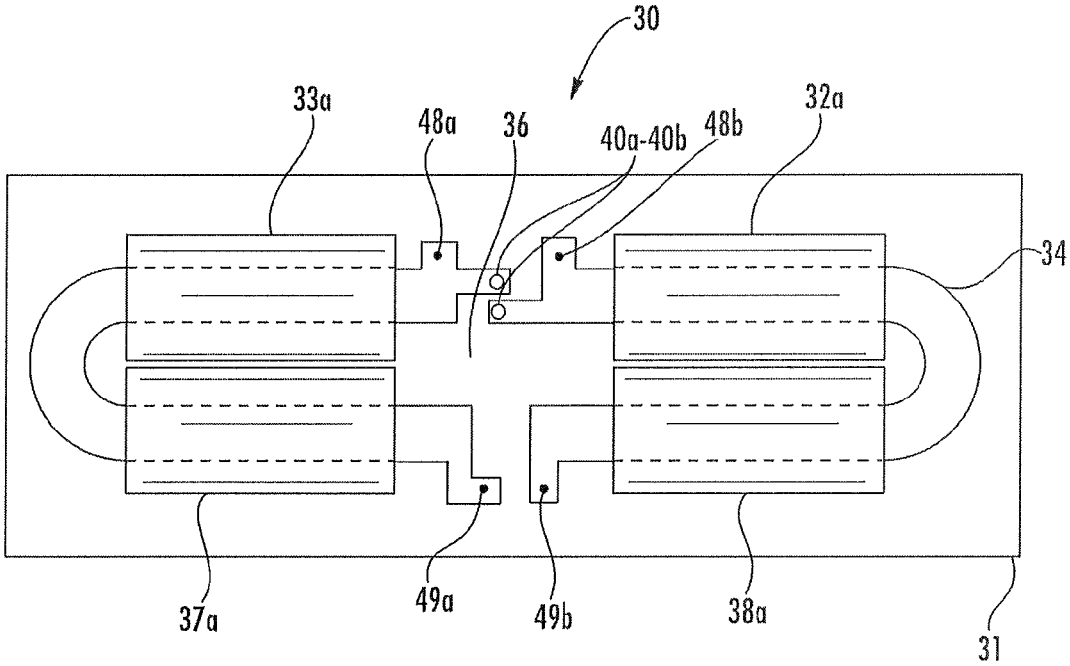
FIG. 5 is a top view of the transmission line transformer of FIG. 3.
Figure 6A:
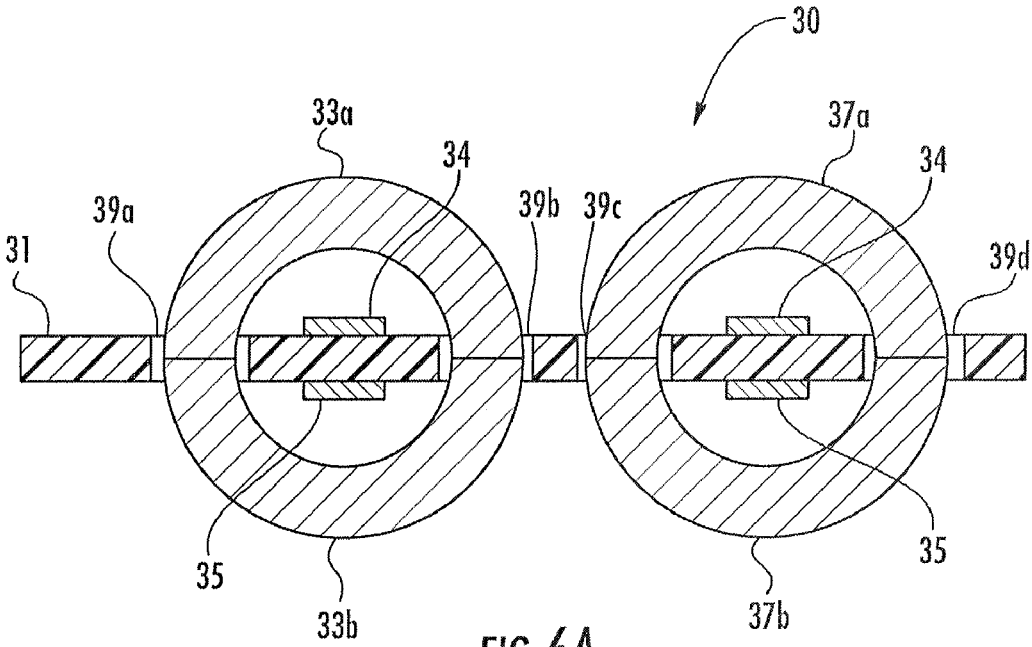
FIG. 6*a* is a cross-sectional view of the transmission line transformer of FIG. 3 along lines 6-6.
Figure 6B:
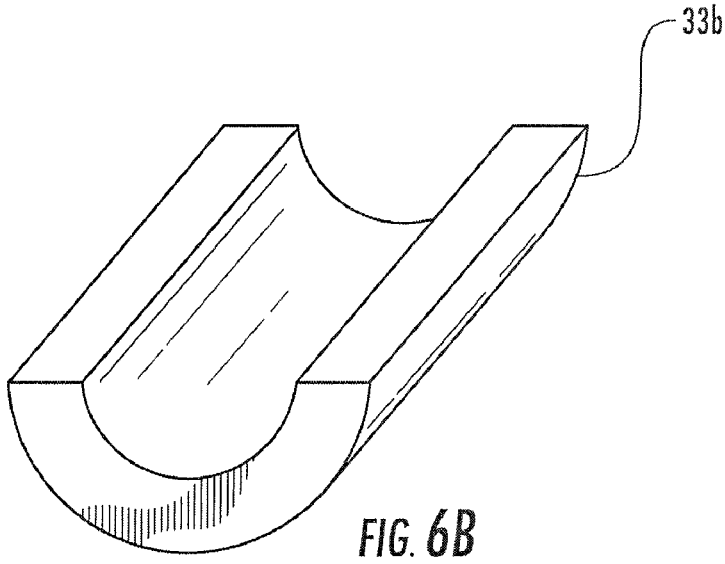
FIG. 6*b* is a perspective view of a single ferromagnetic body from the transmission line transformer of FIG. 3.
Figure 7:
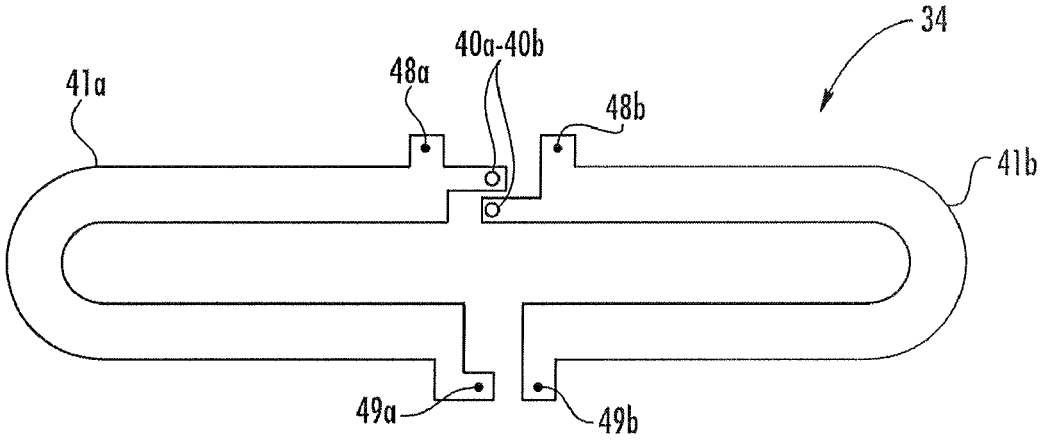
FIG. 7 is a view of the top side conductive layer from the transmission line transformer of FIG. 3.
Figure 8:
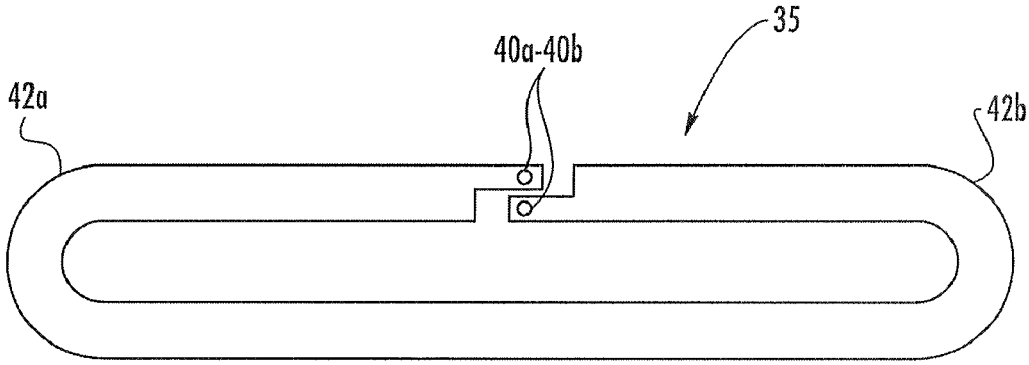
FIG. 8 is a view of the bottom side conductive layer from the transmission line transformer of FIG. 3.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 3-8, a transmission line impedance transformer 30 according to the present invention is now described. The transmission line impedance transformer 30 illustratively includes a printed circuit board (PCB) 31 comprising a dielectric layer and a pair of electrically conductive layers 34-35 on the major surfaces of the PCB. In the illustrated embodiment, the PCB 31 is planar in shape, but may have other shapes in other embodiments, for example, a curved shape. In other embodiments, the PCB 31 may include multiple dielectric layers and multiple electrically conductive layers.

The pair of electrically conductive layers 34-35 defines a medial interconnection portion 36, and first 41*a*, 42*a* and second 41*b*, 42*b* lateral loop portions extending laterally outwardly from opposing first and second sides of the medial interconnection portion. More particularly, the medial interconnection portion 36 illustratively defines an input 48*a*-48*b* and an output 49*a*-49*b*, the input and output having different impedances. Furthermore, the medial interconnection portion 36 illustratively includes a plurality of electrically conductive vias 40*a*-40*b* extending between the pair of electrically conductive layers 34-35 and coupling the layers together.

The PCB 31 illustratively includes a first plurality of ferrite body receiving openings 39*a*-39*d* therein adjacent the first lateral loop portions 41*a*, 42*a* (FIG. 6*a*) and a second plurality of ferrite body receiving openings 39*a*-39*d* (FIG. 6*a*) therein adjacent the second lateral loop portions 41*b*, 42*b*. In the illustrated embodiment, the first and second ferrite body receiving openings 39*a*-39*d* are rectangular in shape, but could have other shapes in other embodiments. The transmission line impedance transformer 30 illustratively includes a plurality of first ferromagnetic bodies 33*a*-33*b*, 37*a*-37*b* extending through the first plurality of ferrite body receiving openings 39*a*-39*d* to surround the first lateral loop portion 41*a*, 42*a*, and a plurality of second ferromagnetic bodies 32*a*-32*b*, 38*a*-38*b* extending through the second plurality of ferrite body receiving openings to surround the second lateral loop portions 41*b*, 42*b*.

In the illustrated embodiment, each of the first 41*a*, 42*a* and second 41*b*, 42*b* lateral loop portions are a U-shaped conductive trace. Further, in the illustrated embodiment and as perhaps best seen in FIG. 6*a*, the first 33*a*-33*b*, 37*a*-37*b* and second 32*a*-32*b*, 38*a*-38*b* ferromagnetic bodies illustratively comprise respective pairs of joined together segments. In other embodiments, the first 33*a*-33*b*, 37*a*-37*b* and second 32*a*-32*b*, 38*a*-38*b* ferromagnetic bodies may be integral. Additionally, in the illustrated embodiment, each of the first ferromagnetic bodies 33*a*-33*b*, 37*a*-37*b* and the second ferromagnetic bodies 32*a*-32*b*, 38*a*-38*b* are tubular in shape. In other embodiments, the first 33*a*-33*b*, 37*a*-37*b* and second 32*a*-32*b*, 38*a*-38*b* ferromagnetic bodies may have other shapes, for example, rectangular. For example, the PCB and the at least one first 33*a*-33*b*, 37*a*-37*b* and second 32*a*-32*b*, 38*a*-38*b* ferromagnetic bodies may define an impedance transformer operable over a frequency range of 2 to 500 MHz. Of course, as will be appreciated by those skilled in the art, the transmission line impedance transformer 30 may be modified to operate over a wide variety of frequencies.

Figure 9:
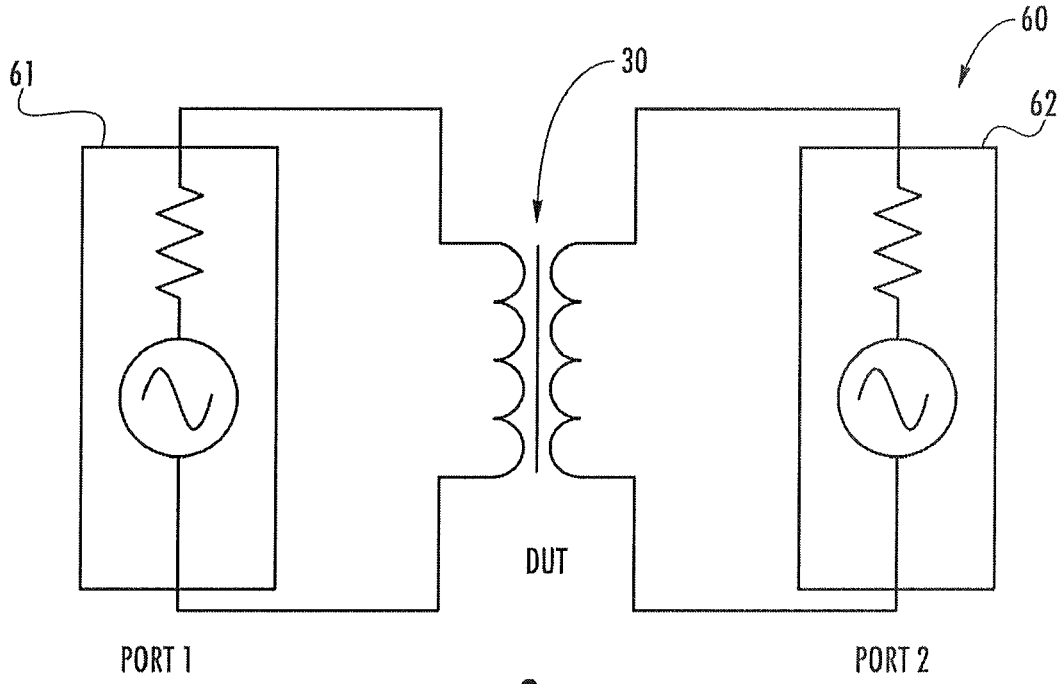
FIG. 9 is a measurement setup for measuring the transmission line transformer of FIG. 3.

Referring now additionally to FIG. 9, a diagram 60 illustrates operation of the transmission line impedance transformer 30. Illustratively, the transmission line impedance transformer 30 transforms an input 61 impedance of 12.5 ξ into an output 62 impedance of 50.0 ξ, an illustrative transformation ratio of 1:4. Of course, as appreciated by those skilled in the art, the transmission line impedance transformer 30 may be modified to have other impedance transformation ratios. Nonetheless, the PCB 31 would be modified accordingly.

Figure 10:
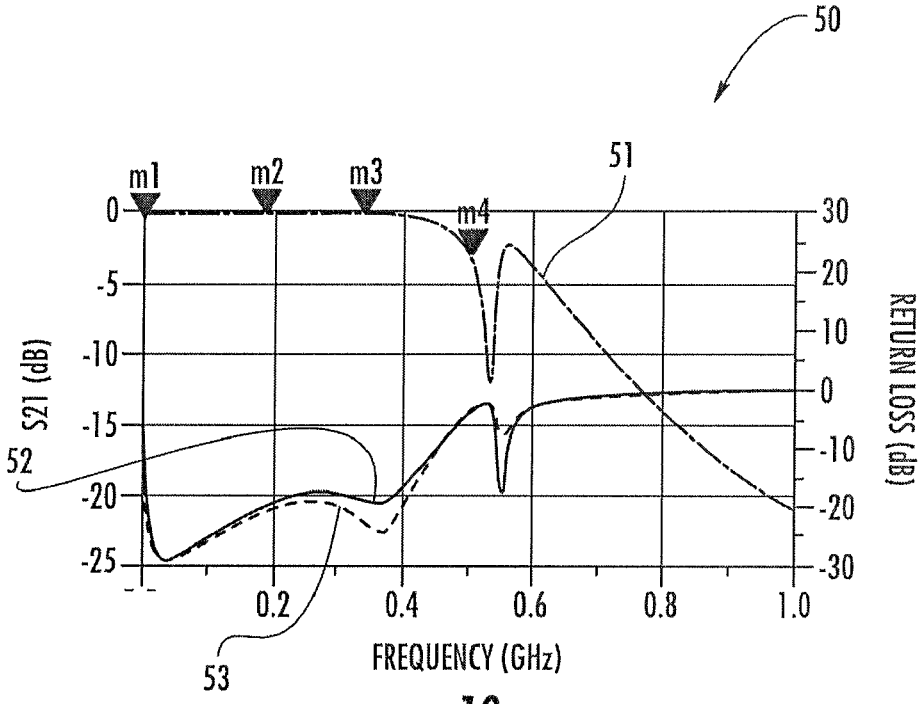
FIG. 10 is a diagram illustrating electrical performance of the transmission line transformer of FIG. 3.

Referring now to FIG. 10, which includes a chart 50 illustrating the electrical performance of the transmission line impedance transformer 30 described above. In particular, the chart 50 includes an x-axis plot for frequency, a left y-axis for insertion loss in decibels, and a right y-axis plot for return loss in decibels (return loss corresponding to how close the impedance looking into the terminal is to the intended design impedance. In the illustrated example, one side should like 50 ξ, and the other side should show 12.5 ξ). Curve 51 illustrates the insertion loss, which maintains a desirable value of less than 0.5 dB over the operating frequency range, see, for example, points M1 Frequency=2.100 MHz, db(S(2,1))=−0.448; M2 Frequency=188.1 MHz, db(S(2,1))=−0.193; M3 Frequency=341.1 MHz, db(S(2,1))=−0.251; and M4 Frequency=505.1 MHz, db(S(2,1))=−3.032. Curves 52-53 illustrate the return loss for the transmission line impedance transformer 30, which is better than −15 decibels over the operating range of 2 to 500 MHz.

Advantageously, the above described transmission line impedance transformer 30 is toroidal and well suited for high frequency/high power applications yet may be manufactured without cumbersome hand wound rigid coaxial cables, as in the prior art. In other words, the transmission line impedance transformer 30 may be manufactured without intensive manual labor. Indeed, the transmission line impedance transformer 30 uses no soldering for assembly and may be manufactured before any wave soldering process is used. Helpfully, the transmission line impedance transformer 30 uses no external assemblies and is more mechanically robust than the typical rigid coaxial cable type transmission line transformer. Moreover, the transmission line impedance transformer 30 is readily manufactured with repeatable and consistent electrical performance since the manual manufacturing component of the typical transmission line transformer is removed. Also, since the transmission line impedance transformer 30 need not use expensive rigid coaxial cable, the cost of manufacture is reduced.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A transmission line impedance transformer comprising:

a printed circuit board (PCB) comprising at least one dielectric layer and at least one electrically conductive layer thereon defining a medial interconnection portion, and first and second lateral loop portions extending laterally outwardly from opposing first and second sides of the medial interconnection portion, said PCB also having a first plurality of ferrite body receiving openings therein adjacent the first lateral loop portion and a second plurality of ferrite body receiving openings therein adjacent the second lateral loop portion;

at least one first ferromagnetic body extending through the first plurality of ferrite body receiving openings to surround the first lateral loop portion; and at least one second ferromagnetic body extending through the second plurality of ferrite body receiving openings to surround the second lateral loop portion.

2. The transmission line impedance transformer according to claim 1 wherein the medial interconnection portion defines an input and an output having different impedances.

3. The transmission line impedance transformer according to claim 1 wherein said at least one electrically conductive layer comprises a pair thereof; and wherein the medial interconnection portion comprises at least one electrically conductive via extending between said pair of electrically conductive layers.

4. The transmission line impedance transformer according to claim 1 wherein each of said first and second lateral loop portions comprises at least one U-shaped conductive trace.

5. The transmission line impedance transformer according to claim 1 wherein said at least one first ferromagnetic body comprises a first plurality thereof for surrounding said first lateral loop portion; and wherein said at least one second ferromagnetic body comprises a second plurality thereof for surrounding said second lateral loop portion.

6. The transmission line impedance transformer according to claim 1 wherein said at least one first ferromagnetic body comprises a respective first pair of joined together segments; and wherein said at least one second ferromagnetic body comprises a respective second pair of joined together segments.

7. The transmission line impedance transformer according to claim 1 wherein said at least one first and at least one second ferromagnetic bodies each comprises a respective tubular ferromagnetic body.

8. A transmission line impedance transformer comprising:

a printed circuit board (PCB) comprising at least one dielectric layer and at least one electrically conductive layer thereon defining a medial interconnection portion, and first and second lateral loop portions extending laterally outwardly from opposing first and second sides of the medial interconnection portion, the medial interconnection portion defining an input and an output having different impedances, said PCB also having a first plurality of ferrite body receiving openings therein adjacent the first lateral loop portion and a second plurality of ferrite body receiving openings therein adjacent the second lateral loop portion;

a plurality of first ferromagnetic bodies extending through the first plurality of ferrite body receiving openings to surround the first lateral loop portion; and a plurality of second ferromagnetic bodies extending through the second plurality of ferrite body receiving openings to surround the second lateral loop portion.

9. The transmission line impedance transformer according to claim 8 wherein said at least one electrically conductive layer comprises a pair thereof; and wherein the medial interconnection portion comprises at least one electrically conductive via extending between said pair of electrically conductive layers.

10. The transmission line impedance transformer according to claim 8 wherein each of said first and second lateral loop portions comprises at least one U-shaped conductive trace.

11. The transmission line impedance transformer according to claim 8 wherein said plurality of first ferromagnetic bodies comprises a respective first pair of joined together segments; and wherein said plurality of second ferromagnetic bodies comprises a respective second pair of joined together segments.

12. The transmission line impedance transformer according to claim 8 wherein each of said first and second ferromagnetic bodies comprises a respective tubular ferromagnetic body.

13. A method of making a transmission line impedance transformer comprising:

providing a printed circuit board (PCB) comprising at least one dielectric layer;

forming at least one electrically conductive layer on the PCB defining a medial interconnection portion, and first and second lateral loop portions extending laterally outwardly from opposing first and second sides of the medial interconnection portion;

forming a first plurality of ferrite body receiving openings in the PCB adjacent the first lateral loop portion and forming a second plurality of ferrite body receiving openings in the PCB adjacent the second lateral loop portion;

positioning at least one first ferromagnetic body to extend through the first plurality of ferrite body receiving openings and to surround the first lateral loop portion; and positioning at least one second ferromagnetic body to extend through the second plurality of ferrite body receiving openings and to surround the second lateral loop portion.

14. The method according to claim 13 wherein forming the at least one electrically conductive layer comprises forming a pair thereof; and further comprising forming the medial interconnection portion to comprise at least one electrically conductive via extending between the pair of electrically conductive layers.

15. The method according to claim 13 wherein forming the at least one electrically conductive layer comprises forming each of the first and second lateral loop portions to comprise at least one U-shaped conductive trace.

16. The method according to claim 13 wherein the positioning of the at least one first ferromagnetic body includes positioning a first plurality of ferromagnetic bodies for surrounding the first lateral loop portion; and wherein the positioning of the at least one second ferromagnetic body includes positioning a second plurality of ferromagnetic bodies for surrounding the second lateral loop portion.

17. The method according to claim 13 wherein the positioning of the at least one first ferromagnetic body includes providing the at least one first ferromagnetic body to comprise a respective first pair of joined together segments; and wherein the positioning of the at least one second ferromagnetic body includes providing the at least one second ferromagnetic body to comprise a respective second pair of joined together segments.

* * * * *